US006262642B1

(12) United States Patent
Bauer

(10) Patent No.: US 6,262,642 B1
(45) **Date of Patent: *Jul. 17, 2001**

(54) CIRCUIT BREAKER ROTARY CONTACT ARM ARRANGEMENT

(75) Inventor: Rolf-Dieter Bauer, Neumunster (DE)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1 day.

(21) Appl. No.: 09/475,374

(22) Filed: Dec. 30, 1999

(30) Foreign Application Priority Data

Nov. 3, 1999 (EP) ..... 99308745

(51) Int. Cl.[7] ..... H01H 75/00; H01H 77/00; H01H 83/00

(52) U.S. Cl. ..... 335/16; 200/244; 218/22

(58) Field of Search ..... 335/16, 147, 195; 218/22, 32; 200/244, 250

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Nordern | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |

(List continued on next page.)

FOREIGN PATENT DOCUMENTS

| | | |
|---|---|---|
| 819 008 | 12/1974 | (BE) . |
| 897 691 | 1/1984 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |

(List continued on next page.)

*Primary Examiner*—Ray Barrera
(74) *Attorney, Agent, or Firm*—Cantor Colburn LLP; Carl B. Horton

(57) ABSTRACT

A rotary contact arrangement for circuit breakers of the type including a pair of contact springs arranged on each side of a rotary contact arm, as the contact springs interconnect between the rotors and the contact arm via a pair of U-shaped levers. The provision of the U-shaped levers provides uniform contact pressure between both pairs of fixed and moveable contacts to prevent contact erosion.

11 Claims, 3 Drawing Sheets

U.S. PATENT DOCUMENTS

| | | | |
|---|---|---|---|
| 3,803,455 | 4/1974 | Willard . | |
| 3,883,781 | 5/1975 | Cotton . | |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamal | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gallard et al. | 335/42 |
| 4,470,027 | 9/1984 | Link et al. | 335/16 |
| 4,479,143 | 10/1984 | Wantanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 * | 5/1994 | Vial et al. | 200/244 |
| 5,313,180 * | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,351,024 * | 9/1994 | Juds et al. | 335/16 |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |

| | | | |
|---|---|---|---|
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | |
|---|---|---|
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 1 227 978 | 4/1986 | (RU) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER ROTARY CONTACT ARM ARRANGEMENT

BACKGROUND OF INVENTION

This invention relates to circuit breaker, and, more particularly, to a circuit breaker rotary contact arm arrangement.

Circuit breakers having a current interrupting module within a rotary contact arm arrangement whereby the circuit breaker movable contact arms are arranged at the opposite ends of the movable contact carrier are able to interrupt circuit current at a faster rate than circuit breakers having a movable contact carrier with a contact arranged at one end. U.S. Pat. No. 5,310,971 entitled Rotary Contact System for Circuit Breakers, describes a rotary contact arm that employs rollers between the contact springs and the contact arm to provide a uniform force distribution between the fixed contacts attached to the circuit breaker line and load straps and the movable contacts arranged at the opposite ends of the movable contact arm. One problem associated with a non-uniform force distribution between the fixed and movable contacts is the possibility of excessive contact erosion on the pair of contacts at the lower force points along the fixed contact surface.

U.S. patent application Ser. No. 09/384,908 filed Aug. 27, 1999 entitled Rotary Contact Assembly For High Ampere-Rated Circuit Breakers describes connecting the circuit breaker contact springs with the movable contact arm by means of pivotally-arranged links to compensate for contact wear and erosion over long periods of extensive circuit interruption.

SUMMARY OF THE INVENTION

In an exemplary embodiment of the invention, a rotary contact arrangement for circuit breakers of the type including a pair of contact springs arranged on each side of the rotary contact arm, has the contact springs interconnected between the rotors and the contact arm via a pair of U-shaped levers. The U-shaped lever sidearms interact with the perimeter surfaces of the rotors whereas the bights of the U-shaped levers interact with the shaped surfaces of the contact arm to insure uniform spring force between the fixed and movable contacts.

Uniform contact pressure between both pairs of fixed and movable contacts in a rotary type circuit breaker is provided without having to interpose rollers between the contact springs and the movable contact arm, especially when used in multi-pole circuit breakers that require a separate movable contact arm in each of the separate poles

DESCRIPTION OF THE PREFERRED EMBODIMENT

Figure 1:
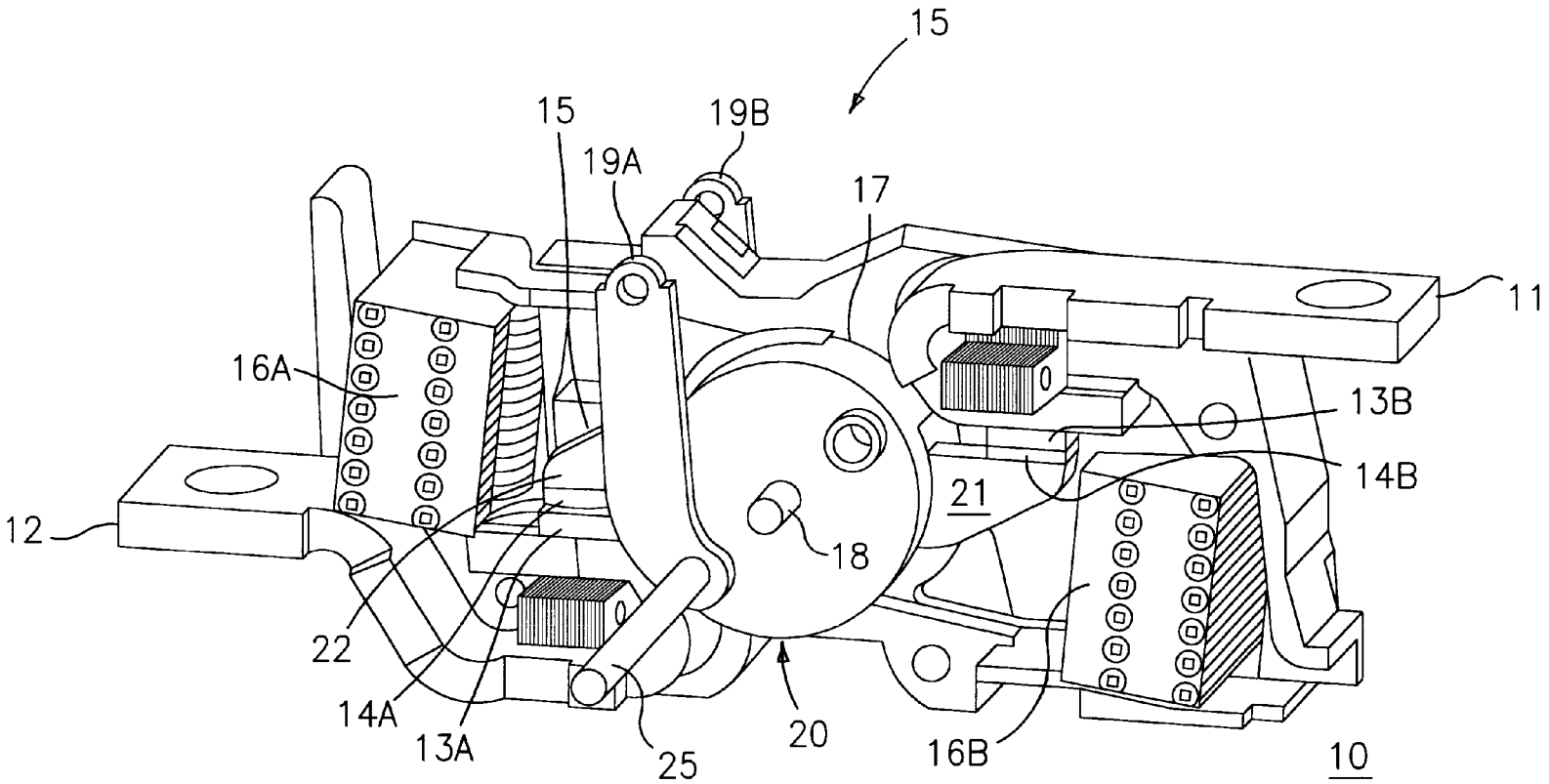
FIG. 1 is a front perspective view of a rotary contact circuit breaker interior employing the rotary contact assembly according to one embodiment of the invention.

Referring to FIG. 1, a rotor assembly 20 in a circuit breaker interior assembly is generally shown intermediate a line strap 11 and a load strap 12 and associated arc chutes 16A, 16B. Although a single rotor assembly is shown, it is to be understood that a seperate rotor assembly is employed within each pole of a multi-pole circuit breaker and that each operates in a similar manner. The arc chutes 16A, 16B are similar to that described in U.S. Pat. No. 4,375,021 entitled Rapid Electric Arc Extinguishing Assembly in Circuit Breaking Devices Such as Electric Circuit Breakers, which is incorporated by reference. Electrical transport through the circuit breaker interior proceeds from the line strap 11 to an associated fixed contact 13B to a movable contact 14B connected to one end of a movable contact arm 15. The current transfers then to the opposite end of movable and fixed contacts 14A, 13A to the associated load strap 12. The movable contact arm 15 moves a pivot 18 (pin) in unison with a rotor 17 upon articulation of the circuit breaker operating mechanism (not shown) by links 19A, 19B to move the movable contacts 14A, 14B between, CLOSED and OPEN positions. The rotor 17 responds to the rotational movement of the pivot 18 to effect the contact closing and opening function. An extended pin 25 provides attachment of the rotor 17 with the circuit breaker operating mechanism through links 19A, 19B to allow manual intervention for opening and closing the circuit breaker contacts in the manner described within the aforementioned U.S. patent application Ser. No. 09/384,908 filed Aug. 27, 2000.

Figure 2:
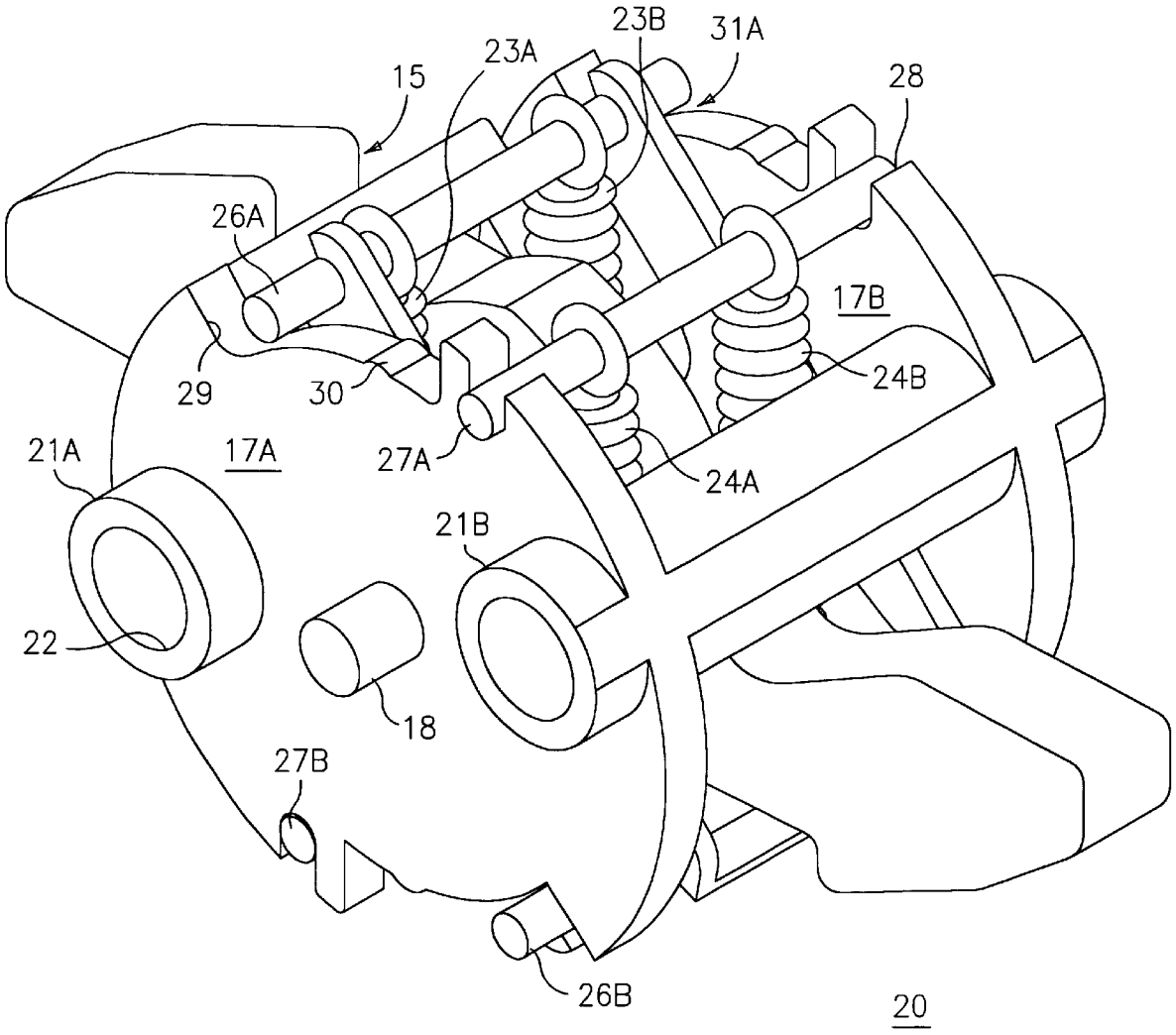
FIG. 2 is an enlarged front perspective view of the rotor assembly contained within the circuit breaker interior of FIG. 1.

Referring to FIG. 2, a rotor assembly 20 a first embodiment of the invention is generally shown as a single unitary assembly comprising a pair of opposing rotor plates 17A, 17B joined by a pair of extended cylinders 21A, 21B each having a passageway as shown at 22. The rotor plates and cylinders are preferably fabricated from a glass-filled thermoset resin having good structural and electrical insulative properties and the central operating pivot 18 extends through both of the rotor plates as well as the movable contact arm 15. The rotor plates 17A, 17B each include, on their opposing perimeters, a U-shaped retainer slot 28 and a sloping carrier slot 29 which includes a raised radial stop as shown at 30. An opposing pair of contact springs 23A, 23B are guided along shaped carrier slots 29 at one end by spring pins 26A, to which one end of the springs is attached and are retained at an opposite end by means of spring pins 27B that are captured within U-shaped retainer slots 28. An opposing pair of contact springs 24A, 24B are guided along shaped carrier slots 29 at one end by spring pins 26B to which one end of the springs is attached and are retained at an opposite end by spring pins 27A that are captured within U-shaped retainer slots 28. The spring pins 26A, 26B and 27A, 27B cooperate with a pair of U-shaped levers 31A, 31B in the manner best seen by now referring to the rotor assembly 20 shown in FIG. 3 with the rotor plate 17A removed and the cylinders 21A, 21B sectioned to depict the U-shaped levers 31A, 31B in greater detail.

Figure 3:
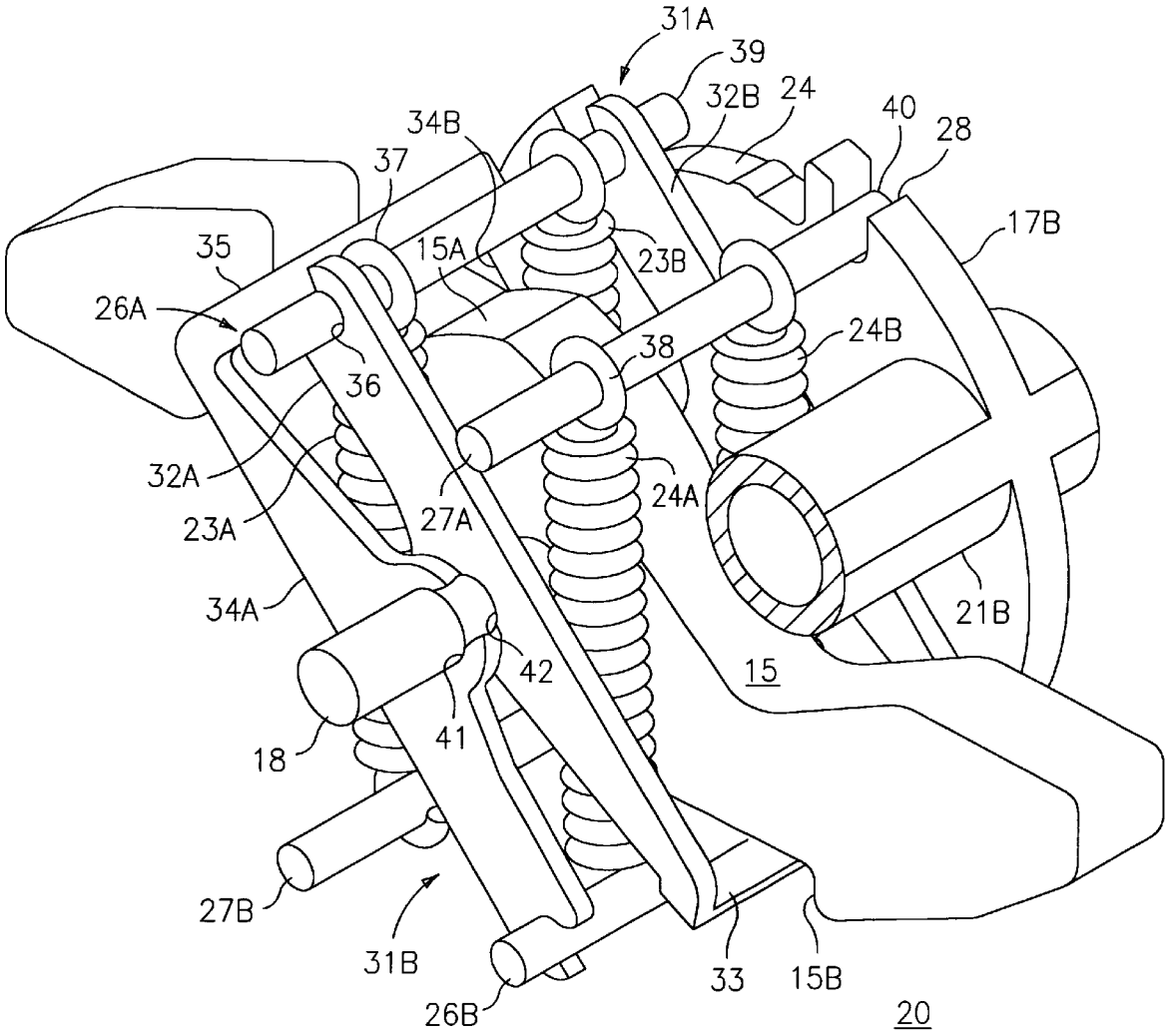
FIG. 3 is an enlarged front perspective view of the rotor assembly contained within the circuit breaker interior of FIG. 2 with the rotor plate removed to depict the U-shaped levers in greater detail.

Referring now to FIG. 3, the U-shaped levers 31A, 31B connect with the central pivot 18 through apertures 41, 42 and each define a pair of opposing sidearms 32A, 32B and 34A, 34B joined by bights 33, 35 respectively. The spring pins 26A, 27A at the ends of the contact springs 23A, 23B extend through openings 36 at the ends of the sidearms 32A, 32B and terminate on the surface of the carrier slot 29, as indicated at 39. The bight 33 joining the sidearms 32A, 32B rides along the surface 1 SB of one end of the movable contact arm 15. The bight 35 joining the sidearms 34A, 34B rides along the surface 15A of the opposite end of the movable contact arm. It is to be understood that the spring pins 26B, 27B are arranged in as similar manner on the rotor plate 17A, shown earlier in FIG. 2.

The provision of the U-shaped levers 31A, 31B intermediate the rotor plates 17A, 17B and the surfaces 15A, 15B on the opposing ends of the movable contact arm 15 thereby allows the forces of the contact springs 23A, 23B and 24A, 24B to interact in feed-back relation, whereby a generally constant force is applied between the fixed and movable contacts 13A, 14A and 13B, 14B of FIG. 1. The forces exhibited by the contact springs at one end of the movable contact arm are transmitted via interaction with the bight associated with the one end to the bight associated with the other end of the movable contact arm to adjust the position of the bight associated with the other end thereof. An increase in force between one pair of fixed and movable contacts at one end of the movable contact arms is accordingly reflected in a corresponding increase in force between the other pair of fixed and movable contacts resulting in a constant force between both pair of fixed and movable contacts through-out the operational life of the associated circuit breaker

What is claimed is:

1. A circuit breaker rotary contact arrangement comprising:

a pair of opposing circular rotor plates, each of said rotor plates defining a carrier slot on a perimeter thereof;

a movable contact arm intermediate said rotor plates, said contact arm defining a first movable contact at one end arranged opposite an opposing first fixed contact and a second movable contact at an end opposite said one end arranged proximate a second fixed contact;

a pivot pin extending through said rotor plates and said movable contact arm, whereby said rotor plates and said movable contact arm rotate in unison;

a pair of first contact springs, one of said first contact springs arranged on one side of said movable contact arm and another of said first contact springs arranged on an opposite side thereof; and a U-shaped lever intermediate said rotor plates, said U-shaped lever defining a pair of sidearms joined at one end by a bight, said bight arranged proximate a first shaped surface formed on said contact arm for providing a constant spring force between said first and second fixed and movable contacts.

2. The rotary contact arrangement of claim 1 including a spring retainer pin arranged through one end of each of said contact springs and through said sidearms, at an end of said sidearms opposite said bight, said retainer pin defining a pair of opposing retainer pin ends, said retainer pin ends being positioned within said rotor carrier slots.

3. The rotary contact arrangement of claim 2 wherein said rotor plates further define a retainer slot on said perimeter thereof and said contact springs include an additional spring retainer pin arranged through another end thereof, said additional spring retainer pin being arranged within said retainer slot.

4. The rotary contact arrangement of claim 2 including an additional U-shaped lever intermediate said rotor plates, said additional U-shaped lever defining a pair of additional sidearms joined at one end by an additional bight, said additional bight arranged proximate a second shaped surface formed on said contact arm.

5. The rotary contact arrangement of claim 4 including a pair of additional contact springs, one of said additional contact springs arranged on said one side of said movable contact arm and another of said additional contact springs arranged on said opposite side thereof.

6. The rotary contact arrangement of claim 5 including a first additional spring retainer pin arranged through one end of each of said additional contact springs and through said additional sidearms, at an end of said additional sidearms opposite said additional bight, said additional retainer pin defining a first pair of additional opposing retainer pin ends, said pair of opposing additional retainer pin ends being positioned within additional carrier slots on the rotor plates perimeters.

7. The rotary contact arrangement of claim 6 wherein each of said rotor plates further define a retainer slot on said perimeter thereof and said additional contact springs include a second additional spring retainer pin arranged through another end thereof, said second additional retainer pin defining a second pair of opposing additional retainer pin ends, said second pair of opposing additional spring retainer pin ends being arranged within said retainer slots.

8. A circuit breaker interior assembly comprising:

a line strap arranged for connection with an electric circuit and a load strap electrically connecting with said line strap and arranged for electrically connecting with associated electrical equipment, said line and load straps being intermittently connected by a rotary contact arrangement, said rotary contact arrangement comprising a pair of opposing circular rotor plates, each of said rotor plates defining a carrier slot on a perimeter thereof;

a pair of first and second arc chutes, said first arc chute proximate said line strap and said second arc chute proximate said load strap for quenching arcs occurring upon overcurrent transfer between said line and load straps;

a movable contact arm intermediate said rotor plates, said contact arm defining a first movable contact at one end arranged opposite an opposing first fixed contact and a second movable contact at an end opposite said one end arranged proximate a second fixed contact;

a pivot pin extending through said rotor plates and said movable contact arm whereby said rotor plates and said movable contact arm rotate in unison;

a pair of first contact springs, one of said first contact springs arranged on one side of said movable contact arm and another of said first contact springs arranged on an opposite side thereof; and a U-shaped lever intermediate said rotor plates, said U-shaped lever defining a pair of sidearms joined at one end by a bight, said bight arranged proximate a first shaped surface formed on said contact arm for providing a constant spring force between said first and second fixed and movable contacts.

9. The circuit breaker interior of claim 8 including a spring retainer pin arranged through one end of each of said contact springs and through said sidearms, at an end of said sidearms opposite said bight, said retainer pin defining a pair of opposing retainer pin ends, said retainer pin ends being positioned within said rotor carrier slots.

10. The rotary contact arrangement of claim 9 wherein said rotor plates further define a retainer slot on said perimeter thereof and said contact springs include an additional spring retainer pin arranged through another end thereof, said additional spring retainer pin being arranged within said retainer slot.

11. The rotary contact arrangement of claim 9 including an additional U-shaped lever intermediate said rotor plates, said additional U-shaped lever defining a pair of additional sidearms joined at one end by an additional bight, said additional bight arranged proximate a second shaped surface formed on said contact arm.

* * * * *

UNITED STATES PATENT AND TRADEMARK OFFICE

CERTIFICATE OF CORRECTION

PATENT NO. : 6,262,642 B1
DATED : July 17, 2001
INVENTOR(S) : Rolf-Dieter Bauer

It is certified that error appears in the above-identified patent and that said Letters Patent is hereby corrected as shown below:

Title page,
Item [56], References Cited, U.S. PATENT DOCUMENTS, after "4,259,651 3/1981" delete "Yamal" and insert therefor -- Yamat --; and after "4,468,645 8/1984" delete "Gerbert-Gallard et al." and insert therefor -- Gerbert-Gaillard et al. --

Column 2,
Line 62, after "surface" delete "1 SB" and insert therefor -- 15B --

Column 4,
Line 4, after "said" insert therefor -- first --

Signed and Sealed this

Third Day of May, 2005

JON W. DUDAS
*Director of the United States Patent and Trademark Office*